US010465448B2

(12) United States Patent
Akhmadi Eko et al.

(10) Patent No.: US 10,465,448 B2
(45) Date of Patent: Nov. 5, 2019

(54) DRILL BIT INSERT AND DRILL BIT

(71) Applicant: MITSUBISHI MATERIALS CORPORATION, Tokyo (JP)

(72) Inventors: Wardoyo Akhmadi Eko, Naka-gun (JP); Toshihiko Matsuo, Naka-gun (JP); Chihiro Sakurazawa, Tsukuba (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 57 days.

(21) Appl. No.: 15/543,158

(22) PCT Filed: Jan. 14, 2016

(86) PCT No.: PCT/JP2016/050973
§ 371 (c)(1),
(2) Date: Jul. 12, 2017

(87) PCT Pub. No.: WO2016/114344
PCT Pub. Date: Jul. 21, 2016

(65) Prior Publication Data

US 2018/0010395 A1 Jan. 11, 2018

(30) Foreign Application Priority Data

Jan. 14, 2015 (JP) ..... 2015-005175
Jan. 13, 2016 (JP) ..... 2016-004695

(51) Int. Cl.
*E21B 10/567* (2006.01)
*E21B 10/55* (2006.01)

(52) U.S. Cl.
CPC ..... *E21B 10/5673* (2013.01); *E21B 10/55* (2013.01)

(58) Field of Classification Search
CPC ..... E21B 10/5673; E21B 10/5735
See application file for complete search history.

(56) References Cited

U.S. PATENT DOCUMENTS 3,141,746 A 7/1964 De Lai
3,745,623 A 7/1973 Wentorf, Jr. et al.
(Continued)

FOREIGN PATENT DOCUMENTS

CN 1274761 A 11/2000
CN 1390679 A 1/2003
(Continued)

OTHER PUBLICATIONS

Office Action dated Aug. 28, 2018 for the corresponding Chinese Patent Application No. 201680005575.X.
(Continued)

*Primary Examiner* — Shane Bomar
(74) *Attorney, Agent, or Firm* — Leason Ellis LLP

(57) ABSTRACT

In a drill bit insert of the present invention, an insert body of the drill bit insert includes: a rear end portion forming a columnar shape or a disk-like shape; an intermediate portion having an outer diameter smaller than that of the rear end portion; and an end portion having an outer diameter from the center line of the insert gradually decreasing toward the tip side, the hard surface layer is coated on the insert body from a surface of the end portion of the insert body to an outer periphery of the intermediate portion, and an outer diameter of the hard surface layer on the intermediate portion is equal to that of the rear end portion.

7 Claims, 3 Drawing Sheets

(56) References Cited

U.S. PATENT DOCUMENTS

| | | | | |
|---|---|---|---|---|
| 3,913,280 | A | 10/1975 | Hall | |
| 4,499,795 | A | 2/1985 | Radtke | |
| 5,379,854 | A | 1/1995 | Dennis | |
| 5,423,719 | A | 6/1995 | Jennings | |
| 5,575,342 | A | 11/1996 | Hedlund et al. | |
| 6,003,623 | A * | 12/1999 | Miess | E21B 10/55 175/426 |
| 6,050,354 | A * | 4/2000 | Pessier | E21B 10/16 175/425 |
| 6,332,503 | B1 * | 12/2001 | Pessier | E21B 10/16 175/336 |
| 6,527,069 | B1 * | 3/2003 | Meiners | E21B 10/567 175/432 |
| 2002/0084112 | A1 * | 7/2002 | Hall | E21B 10/5673 175/426 |
| 2006/0157285 | A1 | 7/2006 | Cannon et al. | |
| 2011/0132668 | A1 * | 6/2011 | Bellin | E21B 10/5673 175/428 |
| 2012/0103700 | A1 * | 5/2012 | Lin | E21B 10/5676 175/428 |
| 2012/0222364 | A1 | 9/2012 | Lyons et al. | |
| 2012/0225253 | A1 | 9/2012 | Digiovanni et al. | |
| 2013/0168155 | A1 | 7/2013 | Fang et al. | |
| 2015/0259988 | A1 * | 9/2015 | Chen | E21B 10/5673 175/430 |
| 2018/0216411 | A1 * | 8/2018 | Belnap | E21B 10/5673 |

FOREIGN PATENT DOCUMENTS

| | | | |
|---|---|---|---|
| DE | 3344688 | A | 6/1985 |
| EP | 0214795 | A | 3/1987 |
| EP | 1116858 | A | 7/2001 |
| JP | 62-099083 | A | 5/1987 |
| JP | 04-046183 | U | 4/1992 |
| JP | 06-033677 | A | 2/1994 |
| JP | 2002-349173 | A | 12/2002 |
| JP | 2014-196616 | A | 10/2014 |

OTHER PUBLICATIONS

European Search Report dated Jul. 27, 2018 for the corresponding European Patent Application No. 16737415.6.

International Search Report dated Feb. 23, 2016 for the corresponding PCT Application No. PCT/JP2016/050973.

Office Action dated Aug. 27, 2019 for the corresponding Japanese Patent Application No. 2016-004695.

* cited by examiner

DRILL BIT INSERT AND DRILL BIT

CROSS-REFERENCE TO RELATED PATENT APPLICATIONS

This application is a U.S. National Phase Application under 35 U.S.C. § 371 of International Patent Application No. PCT/JP2016/050973 filed on Jan. 14, 2016 and claims the benefit of Japanese Patent Applications No. 2015-005175 filed on Jan. 14, 2015 and No. 2016-004695 filed on Jan. 13, 2016, all of which are incorporated herein by reference in their entirety. The International Application was published in Japanese on Jul. 21, 2016 as International Publication No. WO/2016/114344 under PCT Article 21(2).

FIELD OF THE INVENTION

The present invention relates to a drill bit insert attached to an end portion of a drill bit to perform a drilling, and to the drill bit in which such drill bit inserts are attached to the end portion.

BACKGROUND OF THE INVENTION

As such a drill bit insert, a drill bit insert is known, in which a hard surface layer made of a sintered material of polycrystalline diamond which is harder than an insert body is coated on the end portion of the insert body made of a cemented carbide. Here, U.S. Pat. No. 5,575,342 proposes: a drill bit insert in which such a hard surface layer coated on an end portion of the insert body having a columnar rear end portion and the hemispherical end portion with an outer diameter decreasing toward a tip side; and a drill bit to which the drill bit insert is attached such that the rear end portion of the insert body is buried in a fitting hole formed in the end portion of the bit body. In addition, U.S. Pat. No. 3,141,746 discloses a method for producing such a polycrystalline diamond sintered material, and in U.S. Pat. Nos. 3,913,280 and 3,745,623 disclose a manufacturing apparatus.

Technical Problem

As shown in U.S. Pat. No. 5,575,342, in a drill bit insert coated with a hard surface layer made of a polycrystalline diamond sintered material as described above, it is normal in a manufacturing method of such a drill bit insert that the thickness of the hard surface layer is thick at a tip of an end portion located on a center line of a column forming a rear end portion of the insert body, and decreases from the tip toward an outer periphery side of the end portion. On the other hand, however, when attaching such a drill bit insert to a drill bit, in a case where an outer diameter of the rear end portion of the insert body is formed larger than an inner diameter of the fitting hole, it is normal to polish the outer periphery of the drill bit insert in order to bury the rear end portion in the fitting hole.

However, in such a polished drill bit insert, there is a concern that up to a portion with a small thickness of the hard surface layer is also polished and the hard surface layer is removed on the outer periphery of the end portion of the insert body, and thereby the surface of the insert body made of cemented carbide is uncovered. When such a drill bit insert is attached to a bit body of the drill bit such that the rear end portion of the insert body is buried in the fitting hole, not only the portion coated with the hard surface layer but also the outer periphery of the end portion where the surface of the insert body is uncovered as described above is exposed from a tip surface of the bit body.

Therefore, when drilling is performed with the drill bit having such a drill bit insert attached thereto, the uncovered surface of the outer periphery of the end portion of the insert body exposed from the tip surface of the bit body wears away and is hollowed earlier than the hard surface layer due to contact with drill cuttings generated during drilling. In some cases, the end portion of the drill bit insert is broken while the hard surface layer remains on the surface of the end portion on an inner peripheral side. Therefore, the drill bit insert reaches the end of tool life in a short period of time, while being unable to sufficiently exhibit the high wear resistance of the hard surface layer made of the high hardness and expensive polycrystalline diamond sintered material.

The present invention is made under such a circumstance, and an objective thereof is to provide a drill bit insert in which a surface of the insert body is covered in a portion exposed from a tip surface of a drill bit even if an outer periphery of a drill bit insert is polished in a case where an outer diameter of a rear end portion of the insert body is formed larger than an inner diameter of a fitting hole, and which sufficiently utilizes the high wear resistance possessed by a hard surface layer and has a long tool life; and provide a drill bit to which such a drill bit insert is attached and which is capable of performing efficient drilling and has a long tool life.

SUMMARY OF THE INVENTION

Solution to Problem

In order to solve the above problem and to achieve such an objective, a drill bit insert of the present invention attached to an end portion of a drill bit to perform drilling, includes: an insert body; and a hard surface layer coated on the insert body and made of a polycrystalline diamond, which is harder than the insert body. The insert body includes: a rear end portion forming a columnar shape or a disk-like shape centered on a center line of the insert; an intermediate portion arranged at a tip side of the rear end portion in a direction of the center line of the insert, and having an outer diameter smaller than that of the rear end portion; and an end portion arranged at a tip side of the intermediate portion in the direction of the center line of the insert, and having an outer diameter from the center line of the insert gradually decreasing toward the tip side. The hard surface layer is coated on the insert body from a surface of the end portion of the insert body to an outer periphery of the intermediate portion, and an outer diameter of the hard surface layer on the intermediate portion is equal to that of the rear end portion of the insert body.

In addition, a drill bit of the present invention is the drill bit including: a bit body; and such a drill bit insert attached to an end portion of the bit body. A fitting hole is formed on the end portion of the bit body, and the drill bit insert is attached such that the rear end portion of the insert body and at least a portion of the intermediate portion coated with the hard surface layer are buried in the fitting hole.

In the drill bit insert of the present invention, between the rear end portion of the insert body having a columnar shape or a disk-like shape and the end portion having an outer diameter decreasing toward the tip side, the intermediate portion having a smaller outer diameter than that of the rear end portion is arranged, and the outer diameter of the end portion gradually decreases from the intermediate portion to the tip side. The hard surface layer is coated on the insert body from the end portion to the outer periphery of the intermediate portion, and an outer diameter of the hard surface layer on the intermediate portion is equal to that of the rear end portion of the insert body. Therefore, in a case where the outer diameter of the rear end portion of the insert body is larger than an inner diameter of the fitting hole, even when the outer periphery of the drill bit insert is polished, the hard surface layer having the thickness equal to the difference of the outer diameters between the rear end portion and the intermediate portion remains coated on the outer periphery of the intermediate portion.

Accordingly, as the drill bit of the present invention, such a drill bit insert is attached such that the rear end portion of the insert body and at least a portion of the intermediate portion coated with the hard surface layer are buried in the fitting hole, and thus it is possible to prevent the surface of the insert body having a lower hardness than the hard surface layer from being uncovered and exposed from the tip surface of the bit body, and to prevent such a situation that wear progresses from the uncovered surface of the insert body due to contact with drill cuttings and the end portion of the drill bit insert is broken. Therefore, it is possible to provide a drill bit insert and a drill bit having a long tool life by sufficiently exerting the wear resistance of the hard surface layer made of a polycrystalline diamond and to efficiently perform drilling.

Here, as long as the outer diameter of the intermediate portion is smaller than that of the rear end portion, the intermediate portion may have the outer diameter decreasing toward the tip side, for example, a truncated conical shape, or in a case where the end portion is hemispherical, an outer circumferential surface of the intermediate portion smoothly continuing to the end portion may have a curved surface shape. On the other hand, similar to the rear end portion, the intermediate portion forms a columnar shape or a disk-like shape centered on the center line of the insert, and thereby, in a state where the hard surface layer is coated on the intermediate portion, the thickness of the hard surface layer in a radial direction perpendicular to the center line of the insert can be constant in a direction over the center line of the insert. Therefore, in the drill bit, no matter how far the portion coated with the hard surface layer of the intermediate portion is buried in the fitting hole, wear resistance in the portion exposed from the tip surface of the bit body can be ensured sufficiently for the drill bit insert. Accordingly, it is preferable that the intermediate portion forms a columnar shape or a disk-like shape, centered on the center line of the insert and having the outer diameter smaller than that of the rear end portion.

It is desirable that the width of the hard surface layer coated on the outer periphery of the intermediate portion is within a range of 1 mm to 5 mm in the direction of the center line of the insert. If the width is less than 1 mm, there is a concern that the surface of the insert body is uncovered in a case where the drill bit insert is attached in a state of being buried shallowly in the fitting hole or in a case where an opening of the fitting hole wears during the drilling. On the other hand, when the width of the hard surface layer exceeds 5 mm, in a case where the outer diameter of the drill bit insert is larger than the inner diameter of the fitting hole, much time and labor are required to polish the drill bit insert to the predetermined outer diameter. Furthermore, it is desirable that the thickness of the hard surface layer coated on the outer periphery of the intermediate portion is within the range of 300 μm to 1200 μm.

In addition, it is preferable that the width of a portion of the hard surface layer coated on the intermediate portion, which is buried in the fitting hole, is 0.5 mm to 4.5 mm in the direction of the center line of the insert. Furthermore, it is preferable that in the drill bit, the width of a portion of the hard surface layer coated on the intermediate portion, which is not buried in the fitting hole, is 0.5 mm to 1.0 mm in the direction of the center line of the insert.

Advantageous Effects of Invention

As described above, according to the present invention, when the drill bit insert is attached to the tip surface of the drill bit, it is possible to prevent the surface of the insert body of low hardness from being uncovered in the portion exposed from the tip surface of the drill bit. As a result, it is possible to extend the tool life of the drill bit insert and the drill bit by a hard surface layer with high wear resistance and to perform an efficient drilling.

DETAILED DESCRIPTION OF THE INVENTION

Figure 1:
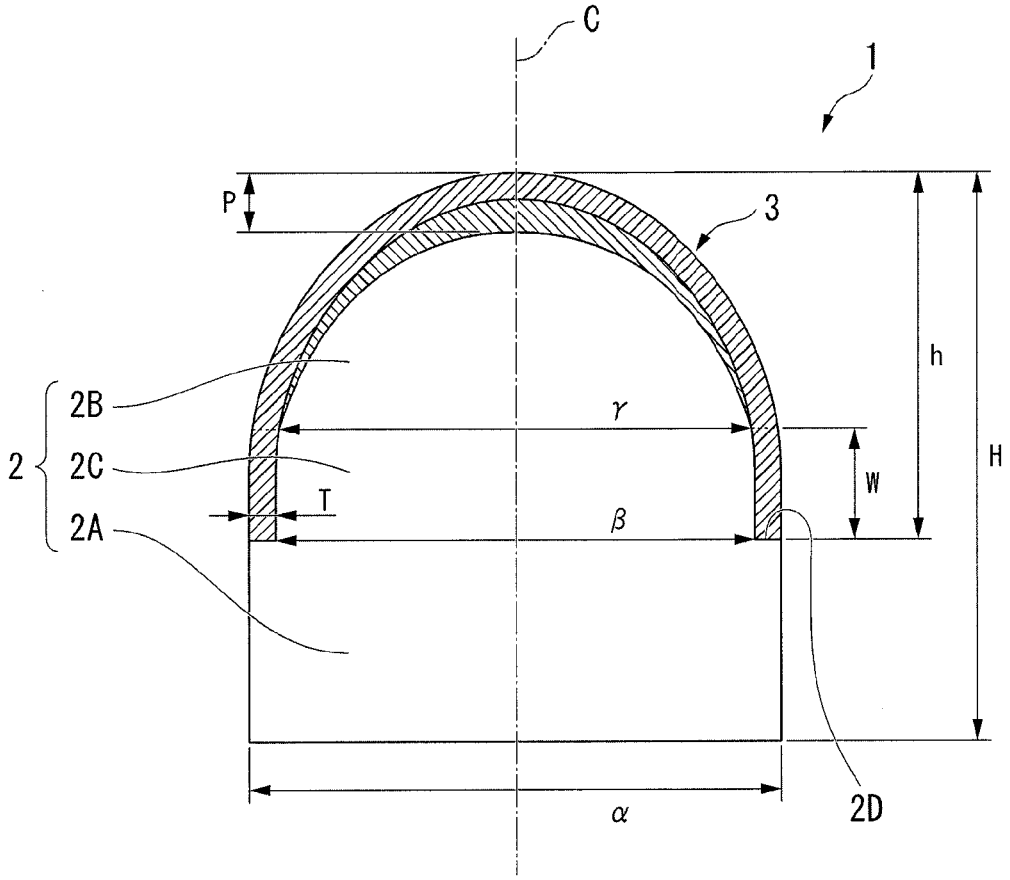
FIG. 1 is a cross-sectional view showing an embodiment of a drill bit insert of the present invention (dashed line is a boundary between an end portion and an intermediate portion of an insert body).
Figure 2:
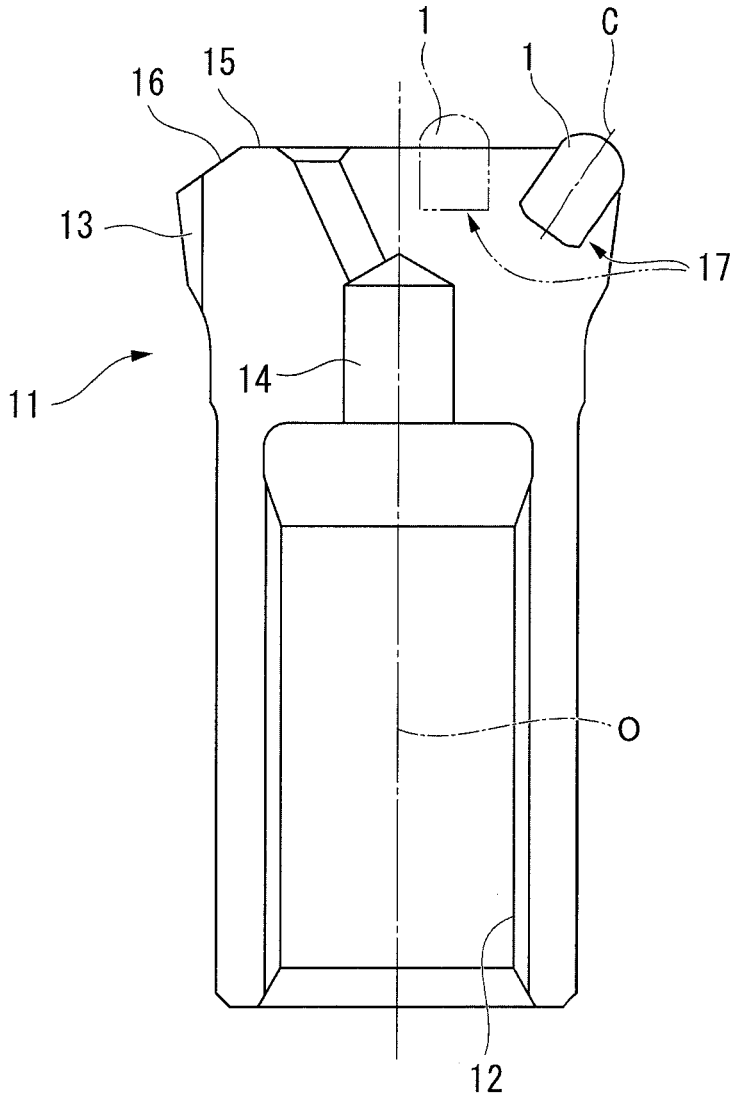
FIG. 2 is a cross-sectional view showing an embodiment of a drill bit of the present invention to which the drill bit insert of the embodiment shown in FIG. 1 is attached to the end portion.
Figure 3:
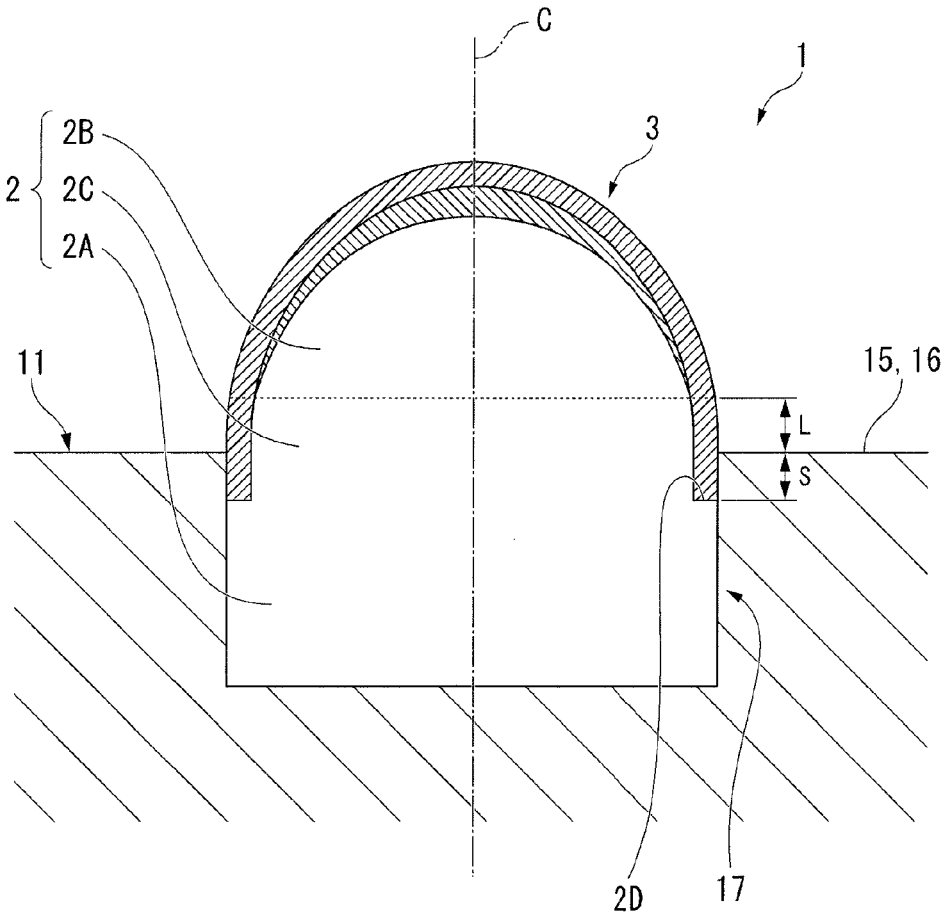
FIG. 3 is an enlarged cross-sectional view showing a portion to which the drill bit insert is attached in the embodiment shown in FIG. 2 (dashed line is a boundary between the end portion and the intermediate portion of the insert body).

FIG. 1 is a cross-sectional view showing an embodiment of a drill bit insert 1 of the present invention. FIG. 2 is a cross-sectional view showing an embodiment of the drill bit of the present invention to which the drill bit insert 1 of the embodiment is attached. FIG. 3 is an enlarged cross-sectional view showing a portion where the drill bit insert 1 is attached to the drill bit of the embodiment. The drill bit insert 1 of the present embodiment is provided with an insert body 2 made of a hard material such as cemented carbide, and a hard surface layer 3 coated on a surface of the insert body 2 and made of a polycrystalline diamond harder than the insert body 2.

In the insert body 2, a rear end portion (lower portion in FIGS. 1 and 3) 2A thereof forms a columnar shape or a disk-like shape centered on a center line of the insert C. In the present embodiment, an end portion (upper portion in FIGS. 1 and 3) 2B forms a hemispherical shape centered on the center line of the insert C with a radius slightly smaller than that of a column or a disk forming the rear end portion 2A, and is formed such that the outer diameter from the center line of the insert C gradually decreases toward a tip side. That is, the drill bit insert 1 of the present embodiment is a button insert. It is preferable that the radius of the rear end of the end portion 2B in the direction of the center line of the insert C is smaller than that of the rear end portion 2A by a layer thickness T or more, which will be described later.

An intermediate portion 2C having an outer diameter slightly smaller than that of the column or the disk forming the rear end portion 2A is formed between the rear end portion 2A and the end portion 2B. In the insert body 2, the rear end portion 2A, the end portion 2B, and the intermediate portion 2C are integrally formed from a hard material such as cemented carbide described above. In addition, a cross-section of the insert body 2 perpendicular to the center line of the insert C has a circular shape centered on the center line of the insert C in any of the rear end portion 2A, the end portion 2B, and the intermediate portion 2C.

Here, in the present embodiment, the intermediate portion 2C forms a columnar shape or a disk-like shape centered on the center line of the insert C, similar to the rear end portion 2A, and is formed to be coaxial with the rear end portion 2A and have the outer diameter smaller than that of the rear end portion 2A. In the upper end portion of the rear end portion 2A corresponding to the boundary position between the rear end portion 2A and the intermediate portion 2C, a table surface 2D that is an annular flat surface facing the tip side of the center line of the insert C (upper side in FIGS. 1 and 3) is formed. By providing such a table surface 2D, the hard surface layer 3 with a sufficient thickness can be formed over the entire intermediate portion 2C. The table surface need not be a plane perpendicular to the center line of the insert C, and may be inclined at 0° to 45° (preferably 0° to 30°) with respect to the radial direction, for example. In addition, the table surface 2D and an outer circumferential surface of the intermediate portion 2C may be connected by a curved surface or an inclined surface. In other words, in the cross-section passing through the center line of the insert C of the insert body 2, the inner circumferential end of the table surface 2D and the rear end of the outer circumferential surface of the intermediate portion 2C are not necessarily connected at right angles, and may be connected by a circular arc, a straight line, or the like. Furthermore, in the cross-section passing through the center line of the insert C of the insert body 2, the tip end of the outer circumferential surface of the rear end portion 2A and the rear end of the outer circumferential surface of the intermediate portion may be connected by a recessed curved line. That is, the table surface 2D may be an annular curved surface.

Furthermore, in the present embodiment, the radius of a hemisphere forming the end portion 2B is equal to that of the column or the disk forming the intermediate portion 2C, and the hemispherical surface forming the surface of the end portion 2B is formed to be smoothly connected to a cylindrical surface forming the outer circumferential surface of the intermediate portion 2C.

On the surface of such an insert body 2, the hard surface layer 3 is coated on only the hemispherical surface forming the surface of the end portion 2B and the cylindrical surface forming the outer circumferential surface of the intermediate portion 2C, from the end portion 2B to the outer periphery of the intermediate portion 2C, and is not coated on the outer circumferential surface of the rear end portion 2A and the rear end surface of the insert body 2. In the present embodiment, the hard surface layer 3 is coated on the entire outer circumferential surface of the intermediate portion 2C. In the hard surface layer 3, the radius from the center line of the insert C of the surface of the hard surface layer 3 coated on the outer circumferential surface of the intermediate portion 2C is equal to that from the center line of the insert C of the outer circumferential surface of the rear end portion 2A. That is, the outer diameter of the hard surface layer 3 in the intermediate portion 2C is equal to that of the rear end portion 2A of the insert body 2.

The hard surface layer 3 may be a hard surface layer of a monolayer in which the grain size of the diamond grain constituting the polycrystalline diamond and the content per grain size, the composition and amount of the binder metal, or the composition and amount of added grains other than the diamond grains is one type, or may be a hard surface layer with two layers as shown in FIGS. 1 and 3 or a hard surface layer with a multilayer structure of three or more layers in which these elements are different. In a case where the hard surface layer 3 is composed of a plurality of layers, it is preferable that the outermost layer coated on the end portion 2B and the outermost layer coated on the intermediate portion are formed from one layer as shown in FIGS. 1 and 3. The sintering of the drill bit insert 1 with such a hard surface layer 3 coated on the insert body 2 is basically performed in a diamond stable region, and can be performed using a known sintering method as disclosed in U.S. Pat. No. 3,141,746 and a known apparatus as disclosed in U.S. Pat. Nos. 3,913,280 and 3,745,623.

However, in order to achieve high wear resistance by the hard surface layer 3 and relaxation of stress of the polycrystalline diamond, it is desirable that the outermost layer of the hard surface layer 3 have a higher hardness than the layer adjacent to the inside thereof, that is, the layer adjacent to the inner side thereof has a lower hardness than the outermost layer. In addition, as described above, the thickness of such a hard surface layer 3 is thick at the tip of the end portion 2B on the center line of the insert C, and the thickness decreases from this tip toward the outer peripheral side of the intermediate portion 2C.

The drill bit in which the drill bit insert 1 is attached to the end portion thereof has a bit body 11 made of steel or the like and having a substantially bottomed cylindrical shape centered on an axis O as shown in FIG. 2, and the bottomed portion thereof is the end portion (upper portion in FIG. 2) to which the drill bit insert 1 is attached.

In addition, a female threaded portion 12 is formed on an inner periphery of the cylindrical rear end portion (lower portion in FIG. 2). A drill rod connected to a drilling apparatus is screwed into the female threaded portion 12, and by transmitting a striking force and an impelling force toward the tip side in the direction of the axis O and a rotating force around the axis O thereto, the drill bit insert 1 crushes a bedrock to form a borehole.

The end portion of the bit body 11 has a slightly larger outer diameter than the rear end portion, a plurality of discharge grooves 13 extending in parallel with the axis O are formed on the outer periphery of the end portion with an interval in the circumferential direction. The drill cuttings generated from the bedrock crushed by the drill bit insert 1 are discharged to a rear end side through the discharge groove 13. In addition, a blow hole 14 is formed along the axis O from the bottom surface of the female threaded portion 12 of the bit body 11 having a bottom. The blow hole 14 branches obliquely at the end portion of the bit body 11, opens to a tip surface of the bit body 11, and ejects a fluid such as compressed air supplied via the drill rod to promote discharge of drill cuttings.

Furthermore, the tip surface of the bit body 11 is provided with a circular face surface 15 centered on the axis O perpendicular to the axis O on the inner periphery side, and a truncated conical gauge surface 16 located on the outer periphery of the face surface 15 and extending toward the rear end side to be closer to the outer peripheral side. The blow hole 14 opens to the face surface 15 and the tip end of the discharge groove 13 opens to the gauge surface 16. Furthermore, on the face surface 15 and the gauge surface 16, a plurality of fitting holes 17 having a circular cross-section are formed perpendicularly to the face surface 15 or the gauge surface 16 in a manner that the holes avoid opening portions of the blow hole 14 and the discharge groove 13, respectively.

In such a fitting hole 17, in a state where the rear end portion 2A of the insert body 2 and at least a portion of the intermediate portion 2C coated with the hard surface layer 3 on the rear end portion 2A side are buried in the fitting hole 17 as shown in FIG. 3, they are interference-fitted by press fitting, shrink fitting or the like or brazed, thereby fixing the drill bit insert 1 to the fitting hole 17. That is, the drill bit insert 1 is buried in the fitting hole 17 and attached thereto.

Therefore, the remaining portion of the intermediate portion 2C on the end portion 2B side and the end portion 2B are respectively protruded from the tip surface of the bit body 11, that is, the face surface 15 or the gauge surface 16, and the center line of the insert C is perpendicular to the face surface 15 or the gauge surface 16. Here, although a portion of the intermediate portion 2C is buried in the fitting hole 17 in FIG. 3, the entire of the intermediate portion 2C may be buried.

As described above, in the drill bit insert 1 having the above-described configuration and the drill bit having the drill bit insert 1 attached to the end portion thereof, the intermediate portion 2C with a diameter smaller than that of the rear end portion 2A is arranged at the tip side of the rear end portion 2A with the large diameter of the insert body 2 of the drill bit insert 1. The end portion 2B for drilling, in which the outer diameter from the center line of the insert C is smaller, is arranged at the further tip side of the intermediate portion 2C. The hard surface layer 3 is coated on the surfaces of the end portion 2B and the intermediate portion 2C, and the outer diameter of the hard surface layer 3 on the outer periphery of the intermediate portion 2C is equal to that of the rear end portion 2A.

Therefore, in a case where the outer diameter of the drill bit insert 1 is larger than the inner diameter of the fitting hole 17, even if the outer circumferential surface of the rear end portion 2A of the insert body 2 of the drill bit insert 1 and the surface of the hard surface layer 3 on the outer periphery of the intermediate portion 2C are polished, the hard surface layer 3 remains on the outer periphery of the intermediate portion 2C as long as the polishing margin is within the range of the outer diameter difference between the rear end portion 2A and the intermediate portion 2C, that is, the thickness of the hard surface layer 3 on the outer periphery of the intermediate portion 2C. This is the same in a case where the outer diameter of the sintered drill bit insert 1 can be buried in the fitting hole 17 as it is and the polishing is not performed.

Accordingly, even if the outer periphery of the drill bit insert 1 is polished, in a state where the rear end portion 2A and at least a portion of the intermediate portion 2C of the insert body 2 are buried in the fitting hole 17 of the bit body 11, as shown in FIG. 3, only the portion coated with the hard surface layer 3 of the drill bit insert 1 is exposed from the face surface 15 or the gauge surface 16 as the tip surface of the bit body 11 and the surface of the insert body 2 made of cemented carbide or the like having a hardness lower than that of the hard surface layer 3 is not exposed.

Therefore, the rear end side portion of the end portion 2B of the insert body 2 and the tip side portion of the intermediate portion 2C are prevented from wearing and being hollowed due to direct contact with the drill cuttings during the drilling, and it is possible to prevent such a situation that the drill bit insert 1 is broken while remaining the hard surface layer. Accordingly, according to the drill bit insert 1 and the drill bit of the above-described configuration, it is possible to sufficiently exhibit the wear resistance of the hard surface layer 3 and thereby to perform long-term drilling and efficient and economical drilling tasks.

It is preferable that the width S in the direction of the center line of the insert C of the portion of the hard surface layer 3 coated on the intermediate portion 2C, which is buried in the fitting hole 17, is 0.5 mm to 4.5 mm. By setting the width S to 0.5 mm or more, even if the periphery of the opening of the fitting hole 17 of the face surface 15 or the gauge surface 16 wears by drilling chips or the like during the drilling and the buried portion of the drill bit insert 1 is exposed, the surface of the insert body 2 is not exposed since the hard surface layer 3 is exposed. Therefore, since the drill bit insert 1 can be prevented from breakage, it is possible to sufficiently exhibit the wear resistance of the hard surface layer 3 coated on the end portion 2B, and thereby to perform long-term drilling. On the other hand, if the width S exceeds 4.5 mm, the range of the hard surface layer 3 increases, which is not preferable because much time and labor are required for polishing the outer periphery of the drill bit insert 1.

In addition, it is preferable that the width L of the portion of the hard surface layer 3 coated on the intermediate portion 2C not buried in the fitting hole 17 (protrusion length of the hard surface layer 3 from the face surface 15 and the gauge surface 16 to the boundary between the end portion 2B and the intermediate portion 2C), is 0.5 mm to 1.0 mm in the direction of the center line of the insert. By setting the width L to 0.5 mm or more, in the drill bit insert 1, only the portion coated with the hard surface layer 3 is exposed from the face surface 15 or the gauge surface 16 as the tip surface of the bit body 11, and the surface of the insert body 2 made of cemented carbide or the like having a hardness lower than that of the hard surface layer 3 is not exposed. Therefore, since the drill bit insert 1 can be prevented from breakage, it is possible to sufficiently exhibit the wear resistance of the hard surface layer 3 coated on the end portion 2B, and thereby to perform long-term drilling. On the other hand, when the width L exceeds 1.0 mm, the area of the hard surface layer 3 increases, which is not preferable because much time and labor are required for polishing the outer periphery of the drill bit insert 1.

In addition, in the drill bit insert 1 of the present embodiment, the intermediate portion 2C of the insert body 2 forms the columnar shape or the disk-like shape centered on the center line of the insert C which is also the center line of the column or the disk forming the rear end portion 2A, and the rear end portion 2A and the intermediate portion 2C are coaxial with each other and have a multistage columnar shape or a multistage disk-like shape in which the diameter decreases by one step toward the tip side of the insert body 2. Therefore, since the thickness of the hard surface layer 3 on the outer periphery of the intermediate portion 2C can be made constant in the direction of the center line of the insert C, even if the drill bit insert 1 is buried to any position in the fitting hole 17, the thickness of the hard surface layer 3 on the outer periphery thereof can be made constant in the portion where the intermediate portion 2C of the insert body 2 protrudes from the face surface 15 or the gauge surface 16, and it is possible to sufficiently ensure the wear resistance in this portion.

Instead of forming the intermediate portion 2C in the columnar shape or the disk-like shape as described above, for example, the intermediate portion 2C may be formed in a truncated conical shape centered on the center line of the insert C having the outer diameter gradually decreasing toward the tip side, or the intermediate portion 2C may have a shape in which the cross-section of the outer circumferential surface along the center line of the insert C is in a protruded curved line shape or a recessed curved line shape, similarly, having the outer diameter gradually decreases toward the tip side. Even in these cases, since the thickness of the hard surface layer 3 increases toward the tip side, it is possible to sufficiently ensure the wear resistance of the hard surface layer 3 in a portion where the intermediate portion 2C of the insert body 2 protrudes from the face surface 15 or the gauge surface 16.

If the width (in the present embodiment, the width in the direction of the center line of the insert C of the intermediate portion 2C between the boundary between the end portion 2B and the intermediate portion 2C indicated by the dashed line in FIGS. 1 and 3, and the boundary between the rear end portion 2A and the intermediate portion 2C) of the hard surface layer 3 coated on the outer periphery of the intermediate portion 2C in the direction of the center line of the insert C indicated by a reference sign W in FIG. 1 is too small, in a case where the drill bit insert 1 is shallowly buried in and attached to the fitting hole 17, or where the periphery of the opening of the fitting hole 17 in the bit body 11 wears during the drilling, there is a concern that the surface of the insert body 2 may be uncovered (there is a possibility that the width S cannot be sufficiently ensured). On the other hand, if the width W of the hard surface layer 3 is too large, much time and labor are required to polish the outer periphery of the drill bit insert 1. Therefore, the width W is desirably in the range of 1 mm to 5 mm, and more desirably in the range of 2.0 mm to 4.0 mm.

In addition, similarly, the thickness of the hard surface layer 3 on the outer periphery of the intermediate portion 2C indicated by a reference sign T in FIG. 1 is desirably in the range of 300 μm to 1200 μm, and more desirably in the range of 500 μm to 1000 μm. If the layer thickness T is thin enough to be less than 300 μm, there is a concern that a sufficient tool life cannot be impart to the drill bit insert 1 even if the hard surface layer 3 is coated on the drill bit insert 1. On the other hand, if the layer thickness T of the hard surface layer 3 is too thick to exceed 1200 μm, the volume of the hard surface layer 3 occupying the portion which is buried in the fitting hole 17 and does not contribute to prevention of wear or the drilling gets large, that is uneconomical. It is preferable that the layer thickness T of the entire hard surface layer 3 formed on the intermediate portion 2C is within the above preferable range.

Here, the position of the rear end of the intermediate portion 2C which is the boundary between the intermediate portion 2C and the rear end portion 2A in the direction of the center line of the insert C, and the position of the tip of the intermediate portion 2C which is the boundary between the intermediate portion 2C and the end portion 2B are defined as follows. In a case where the diameter of the lower end surface of the rear end portion 2A is referred to as a, the rearmost end of the portion having a diameter smaller than 93.3% of a is regarded as the boundary between the intermediate portion 2C and the rear end portion 2A (rear end of the intermediate portion 2C). In a case where the diameter of the rear end of the intermediate portion 2C is referred to as β ($\beta \leq \alpha \times 0.933$), the portion where the diameter is 91.1% of β is regarded as the boundary between the intermediate portion 2C and the end portion 2B (tip of the intermediate portion 2C). That is, the diameter γ of the rear end of the end portion 2B satisfies $\gamma = \beta \times 0.911$.

In addition, the ratio h/H of the length h from the tip of the end portion 2B to the rear end of the intermediate portion 2C with respect to the total length H of the insert body 2 in the direction of the center line of the insert C is preferably 0.45 to 0.80, and more preferably 0.50 to 0.75. By setting h/H in this range, the above-described effect can be more reliably achieved.

In the drill bit insert 1 of the present embodiment, the case where the present invention is applied to a button type drill bit insert in which the end portion 2B of the insert body 2 has a hemispherical shape as described above, is described. However, it is possible to apply the present invention to a so-called ballistic type drill bit insert in which the end portion of the insert body forms a bullet-shape, and to a so-called spike type drill bit insert in which the rear end side of the end portion has a conical surface shape and decreases in diameter toward the tip side, and of which a tip end has a spherical shape with a smaller radius than that of the cylindrical rear end portion of the insert body.

EXAMPLES

Next, in the drill bit insert and the drill bit of the present invention, the difference in effect due to the difference in the width W of the hard surface layer 3 in the above-described embodiment will be demonstrated with reference to examples. In the present example, six types of the drill bit inserts 1 having the width W of the hard surface layer 3 (corresponding to the width of the intermediate portion 2C), the thickness T of the hard surface layer, and the protrusion length (protrusion length of the intermediate portion 2C) L from the face surface 15 and the gauge surface 16 to the boundary between the end portion 2B and the intermediate portion 2C in the above embodiment shown in Table 1, were manufactured. Six drill bits to which these drill bit inserts 1 were attached by burying the rear end portion 2A and the intermediate portion 2C of the insert body 2 in the fitting hole 17 formed in the end portion of the bit body 11, respectively, were manufactured. These are referred to as Examples 1 to 6. In addition, as comparative examples with respect to these Examples 1 to 6, the drill bit having a width W of 0 mm, that is, the drill bit in which the insert body did not have the intermediate portion with a smaller diameter than the rear end portion and a hemispherical end portion with the same radius as that of the rear end portion is directly formed on the tip side of the rear end portion, and the drill bit with a width W of 0.5 mm, were manufactured. These are referred to as Comparative Examples 1 and 2. Furthermore, two types of the drill bits were manufactured, which were the same as Example 1 except that the thickness T of the hard surface layer 3 on the outer periphery of the intermediate portion 2C was changed. These are referred to as Comparative Examples 3 and 4. In addition, two types of the drill bits were manufactured, which were the same as Example 2 except that the protrusion length L of the intermediate portion 2C was changed. These are referred to as Comparative Examples 5 and 6.

Each drill bit insert attached to the drill bits of Examples 1 to 6 and Comparative Examples 1 to 6 was a button type drill bit insert of which the end portion 2B formed a hemispherical shape where the outer diameter of the hard surface layer 3 coated on the end portion 2B was equal to that of the column or the disk forming the rear end portion 2A of the insert body 2, and this outer diameter was 11 mm The thickness T of the hard surface layer 3 on the outer periphery of the intermediate portion 2C of the insert body 2 was 400 μm in Examples 1 to 3 and Comparative Examples 1, 2, 5, and 6, 350 μm in Example 4, 1100 μm in Example 5, 600 μm in Example 6, 150 μm in Comparative Example 3, and 1500 μm in Comparative Example 4. The thickness of the hard surface layer at the tip of the end portion 2B in the direction of the center line of the insert C indicated by a reference sign P in FIG. 1 was 1200 μm in Examples 1 to 3 and Comparative Examples 1, 2, 5, and 6, 800 μm in Example 4, 1150 μm in Example 5, 1000 μm in Example 6, 600 μm in Comparative Example 3, and 1800 μm in Comparative Example 4. Therefore, in each Example and Comparative Example, the outer diameter (diameter) of the rear end portion 2A of the insert body 2 was 11 mm, and the outer diameter of the intermediate portion 2C except for Comparative Example 1 was 10.2 mm (diameter of the hemisphere constituting the end portion 2B was 10.2 mm). In addition, the length of the rear end portion 2A in the direction of the center line of the insert C was 7.5 mm.

In addition, the hard surface layer 3 had a two-layer structure as shown in FIG. 1. The outer layer of the hard surface layer 3 contained 30 vol % of diamond grains with a grain size of 2 to 4 μm, and 70 vol % of diamond grains with a grain size of 20 to 40 μm, did not contain additive grains, and was a high hardness layer formed using 15 vol % (content ratio with respect to the entire layer containing grains) of a metal binder containing Ni: 100 wt %. The average thickness of the outer layer of the hard surface layer 3 was 800 μm in Examples 1 to 3 and Comparative Examples 1, 2, 5 and 6, 500 μm in Example 4, 900 μm in Example 5, 800 μm in Example 6, 300 μm in Comparative Example 3, and 1600 μm in Comparative Example 4. The inner layer of the hard surface layer 3 contained 60 vol % of diamond grains with a grain size of 4 to 6 μm and 40 vol % of TaC grains with a grain size of 0.5 to 2 μm as additive grains, and was a low hardness layer formed using 10 vol % of a metal binder containing Co: 100 wt %. The average thickness of the inner layer of the hard surface layer 3 was 200 μm in Examples 1 to 3 and Comparative Examples 1, 2, 5 and 6, 350 μm in Example 4, 200 μm in Example 5, 300 μm in Example 6, and 120 μm in Comparative Examples 3 and 4. The average thickness of the outer layer of the hard surface layer 3 was defined as the average value of the layer thickness in the direction of the center line of the insert C in the cross-section along the center line of the insert C as shown in FIG. 1, and the layer thicknesses on the two straight lines passing through the center of the hemisphere forming the end portion of the drill bit insert (point of intersection of the dotted line indicating the boundary between the intermediate portion 2C and the end portion 2B with the center line of the insert C in FIG. 1) and intersecting with the center line of the insert C at an angle of 30° and 60°. In addition, the average thickness of the inner layer of the hard surface layer 3 was defined as the average value of the layer thickness in the direction of the center line of the insert and the layer thicknesses on the two straight lines passing through the center of the hemisphere forming the end portion of the drill bit insert and intersecting with the center line of the insert C at an angle of 30° and 60°.

Furthermore, in the drill bits of Examples 1 to 6 and Comparative Examples 1 to 6, two such drill bit inserts were attached to the face surface 15 and five to the gauge surface 16, seven in total, in each the bit body 11 with a bit diameter of 45 mm. The protrusion length from the face surface 15 and the gauge surface 16 to the boundary between the end portion 2B and the intermediate portion 2C of the insert body 2, indicated by a reference sign L in FIG. 3 was 1 mm in Examples 1 to 3, 5 and Comparative Examples 2 to 4, 0.5 mm in Example 4, 0.8 mm in Example 6, 3 mm in Comparative Example 5, and 0 mm in Comparative Example 6. In Comparative Example 1, the drill bit insert was attached to the bit body 11 so that the rear end portion 2A was exposed only by 1 mm in the direction of the center line of the insert C from the boundary between the rear end portion 2A and the end portion 2B (so that the distance from the face surface 15 and the gauge surface 16 to the boundary between the rear end portion 2A and the end portion 2B is 1 mm).

The drilling tasks were performed using these drill bits to drill the borehole with a drilling length of 4 m in a copper mine with an average uniaxial compression strength of 150 MPa made of medium-hard rock. The total drilling distance (m) until the drill bit insert reaches the end of the tool life was measured, and the damaged form of the drill bit insert and the drill bit at the end of the drilling was confirmed. Drilling conditions were as follows: a drilling apparatus was model No. H205D manufactured by TAMROCK Co., Ltd., striking pressure was 160 bar (16 MPa), feed pressure was 80 bar (8 MPa), rotational pressure was 55 bar (5.5 MPa), and water with pressure of 18 bar (1.8 MPa) was supplied from the blow hole. The results are shown in Table 1.

TABLE 1

| | Width of hard surface layer W (mm) | Thickness of hard surface layer T (μm) | Protrusion length of intermediate portion L (mm) | Total drilling distance | Damaged form of insert and bit |
|---|---|---|---|---|---|
| Example 1 | 1.5 | 400 | 1 | 544 m | Insert normally wore, and a portion thereof was broken at base |
| Example 2 | 3 | 400 | 1 | 912 m | Insert normally wore |
| Example 3 | 4 | 400 | 1 | 1056 m | Insert normally wore |
| Example 4 | 2 | 350 | 0.5 | 456 m | Insert normally wore |
| Example 5 | 4 | 1100 | 1 | 1128 m | Insert p normally wore |
| Example 6 | 3 | 600 | 0.8 | 872 m | Insert normally wore |
| Comparative Example 1 | 0 | (400) | (1) | 236 m | Insert was broken at base |
| Comparative Example 2 | 0.5 | 400 | 1 | 392 m | Insert was broken at base |
| Comparative Example 3 | 1.5 | 150 | 1 | 408 m | Insert was broken at base |
| Comparative Example 4 | 1.5 | 1500 | 1 | 288 m | Insert was broken at base |
| Comparative Example 5 | 3 | 400 | 3 | 256 m | Insert was broken at base |
| Comparative Example 6 | 3 | 400 | 0 | 160 m | Bit body wore in advance, and buried insert was detached |

From these results, in the drill bit to which the drill bit inserts of Comparative Examples 1 and 2 were attached, in which the width W of the hard surface layer 3 was short or zero, even in Comparative Example 2 resulting in a long drilling distance, wear occurred at the base of the drill bit insert (surface side of a part of the bit body protruding from the surface of the bit body), and the insert body 2 was hollowed. The total drilling distance was less than 400 m, that is, 100 holes cannot be drilled and the end of tool life was reached. Even in the drill bit to which the drill bit insert of Comparative Example 3 in which the thickness T of the hard surface layer 3 was small was attached, wear occurred from the base of the drill bit insert, and the total drilling distance was short as compared with Examples 1 to 6. In Comparative Example 4 in which the thickness T of the hard surface layer 3 was large, the total drilling distance was short as compared with Examples 1 to 6. In Comparative Example 5 in which the protrusion length L of the intermediate portion 2C was long, the length (S in FIG. 3) of the portion buried in the bit body 11 of the intermediate portion 2C was short and the drill bit insert was broken at the base thereof. In addition, in Comparative Example 6 in which the protrusion length L of the intermediate portion 2C was 0 mm, that is, only the end portion 2B was protruded from the face surface 15 and the gauge surface 16, the bit body 11 wore in advance and the drill bit insert was detached from the bit body 11.

On the other hand, in the drill bits to which the drill bit inserts of Examples 1 to 6 were attached, breakage occurred in a portion of the drill bit insert in Example 1, whereas others were able to drill 100 holes or more until the end of tool life was reached with normal wear. In Examples 2 and 3, the thickness T of the hard surface layer 3 and the protrusion length L of the intermediate portion 2C are the same as each other, and it was possible to extend the tool life by 2 to 3 times or more as long as Comparative Example 2 in which the width W of the hard surface layer 3 is small.

INDUSTRIAL APPLICABILITY

As described above, according to the present invention, it is possible to prevent the surface of the insert body of low hardness from being uncovered in the portion exposed from the tip surface of the drill bit. It is possible to extend the tool life of the drill bit insert and the drill bit by a hard surface layer having high wear resistance and to perform an efficient drilling.

REFERENCE SIGNS LIST

1 DRILL BIT INSERT
2 INSERT BODY
2A REAR END PORTION OF INSERT BODY 2
2B END PORTION OF INSERT BODY 2
2C INTERMEDIATE PORTION OF INSERT BODY 2
2D ANNULAR TABLE SURFACE
3 HARD SURFACE LAYER
11 BIT BODY
15 FACE SURFACE (TIP SURFACE) OF BIT BODY 11
16 GAUGE SURFACE (TIP SURFACE) OF BIT BODY 11
17 FITTING HOLE
C CENTER LINE OF INSERT
O AXIS OF BIT BODY 11
W WIDTH OF HARD SURFACE LAYER 3 IN DIRECTION OF CENTER LINE OF INSERT C ON OUTER PERIPHERY OF INTERMEDIATE PORTION 2C
L WIDTH OF PORTION OF HARD SURFACE LAYER NOT BURIED IN FITTING HOLE 17 IN DIRECTION OF CENTER LINE OF INSERT C ON OUTER PERIPHERY OF INTERMEDIATE PORTION 2C
S WIDTH OF PORTION OF HARD SURFACE LAYER BURIED IN FITTING HOLE 17 IN DIRECTION OF CENTER LINE OF INSERT C ON OUTER PERIPHERY OF THE INTERMEDIATE PORTION 2C

The invention claimed is:

1. A drill bit insert attached to an end portion of a drill bit to perform drilling, the drill bit insert comprising:
an insert body; and
a hard surface layer coated on the insert body and made of a polycrystalline diamond, which is harder than the insert body, wherein
the insert body comprises: a rear end portion forming a columnar shape or a disk-like shape centered on a center line of the insert; an intermediate portion arranged at a tip side of the rear end portion in a direction of the center line of the insert, and having an outer diameter smaller than that of the rear end portion; and an end portion arranged at a tip side of the intermediate portion in the direction of the center line of the insert, and having an outer diameter from the center line of the insert gradually decreasing toward the tip side,
the hard surface layer is coated on the insert body from a surface of the end portion of the insert body to an outer periphery of the intermediate portion,
an outer diameter of the hard surface layer on the intermediate portion is equal to that of the rear end portion of the insert body,
a thickness of the hard surface layer of the end portion decreases from a tip of the end portion all the way toward the outer periphery of the intermediate portion,
the intermediate portion forms a columnar shape or a disk-like shape, centered on the center line of the insert, and
a thickness of the hard surface layer of the intermediate portion in a radial direction perpendicular to the center line of the insert is constant in a direction parallel to the center line of the insert.

2. The drill bit insert according to claim 1, wherein
a width of the hard surface layer coated on the outer periphery of the intermediate portion is within a range of 1 mm to 5 mm in a direction parallel to the center line of the insert.

3. The drill bit insert according to claim 1, wherein
a thickness of the hard surface layer coated on the outer periphery of the intermediate portion is within a range of 300 μm to 1200 μm.

4. A drill bit, comprising:
a bit body; and
the drill bit insert according to claim 1 that is attached to an end portion of the bit body, wherein
a fitting hole is formed on the end portion of the bit body, and
the drill bit insert is attached such that the rear end portion of the insert body and at least a portion of the intermediate portion coated with the hard surface layer are buried in the fitting hole.

5. The drill bit according to claim 4, wherein
the width of the portion of the hard surface layer coated on the intermediate portion, which is buried in the fitting hole, is 0.5 mm to 4.5 mm in a direction parallel to the center line of the insert.

6. The drill bit according to claim 4, wherein
the width of the portion of the hard surface layer coated on the intermediate portion, which is not buried in the fitting hole, is 0.5 mm to 1.0 mm in a direction parallel to the center line of the insert.

7. The drill bit insert according to claim 1, wherein the thickness of the hard surface layer is the thickest at the tip of the end portion and gradually and continuously decreases from the tip of the end portion all the way toward the outer periphery of the intermediate portion.

* * * * *